US005565088A

United States Patent [19]

Nair et al.

[11] Patent Number: 5,565,088

[45] Date of Patent: Oct. 15, 1996

[54] HYDROCRACKING PROCESS FOR ENHANCED QUALITY AND QUANTITY OF MIDDLE DISTILLATES

[75] Inventors: Vinayan Nair, Oak Park; Deng-Yang Jan, Elk Grove, both of Ill.

[73] Assignee: UOP, Des Plaines, Ill.

[21] Appl. No.: 319,175

[22] Filed: Oct. 6, 1994

[51] Int. Cl.[6] ..... C10G 65/12; C10G 47/20

[52] U.S. Cl. ..... 208/58; 208/59; 208/111

[58] Field of Search ..... 208/58, 59, 111

[56] References Cited

U.S. PATENT DOCUMENTS

| | | | |
|---|---|---|---|
| 4,661,239 | 4/1987 | Steigleder | 208/111 |
| 4,793,984 | 12/1988 | Lok et al. | 423/306 |
| 4,859,312 | 8/1989 | Miller | 208/111 |
| 4,880,760 | 11/1989 | Pellet et al. | 502/67 |
| 4,913,798 | 4/1990 | Gortsema et al. | 208/111 |
| 4,913,799 | 4/1990 | Gortsema et al. | 208/89 |
| 4,921,594 | 5/1990 | Miller | 208/58 |
| 4,960,504 | 10/1990 | Pellet et al. | 208/411 |
| 5,149,421 | 9/1992 | Miller | 208/114 |
| 5,385,663 | 1/1995 | Zimmerman et al. | 208/58 |

*Primary Examiner*—Asok Pal
*Assistant Examiner*—Bekir L. Yildirim
*Attorney, Agent, or Firm*—Thomas K. McBride; John F. Spears, Jr.

[57] ABSTRACT

The invention is a hydrocracking process which produces an increased amount of hydrocarbons useable as diesel fuel by isomerization of high boiling paraffins using a dewaxing catalyst. The process is characterized by the use of a dewaxing catalyst containing a very small amount of a non-noble metal hydrogenation component such as nickel on an intermediate pore nonzeolitic molecular sieve (NZMS) material. This dewaxing catalyst has been found to be very effective in reducing the pour point of a diesel boiling range distillates even in the presence of sulfur levels which adversely affect catalysts containing higher amounts of the same metal component.

16 Claims, No Drawings

HYDROCRACKING PROCESS FOR ENHANCED QUALITY AND QUANTITY OF MIDDLE DISTILLATES

FIELD OF THE INVENTION

The invention is a hydrocarbon conversion process for hydrocracking hydrocarbons. The invention relates more directly to a hydrocracking process which yields improved quality catalytically dewaxed diesel fuel. The invention specifically relates to a process wherein a feed stream is hydrocracked using a catalyst comprising a non-zeolitic molecular sieve and a very limited quantity of a hydrogenation component such as nickel.

RELATED ART

Hydrocracking processes are well developed and are used commercially in petroleum refineries for the conversion or upgrading of mixtures of hydrocarbons to more valuable lighter products. Hydrocracking may be employed for the conversion of a wide variety of feedstocks ranging from a light material such as a naphtha to heavy black oils such as vacuum column bottoms. Hydrocracking is more normally applied to the conversion of a relatively heavy or residual material such as a vacuum gas oil to gasoline or middle distillates including diesel and jet fuels.

A specific example of a hydrocracking process intended for the production of middle distillates is provided in U.S. Pat. No. 4,661,239 issued to K. Z. Steigleder, which is incorporated herein by reference. This reference describes hydrocracking catalysts containing Y zeolites of specific unit cell sizes, typical hydrogenation metals, inorganic oxide matrix materials and operating conditions. The most preferred matrix materials of this reference (in addition to the zeolite) is a mixture of alumina and silica-alumina. The hydrogenation components are described as Group VIB and Group VIII metals exemplified by molybdenum, tungsten, chromium, iron, cobalt, nickel and noble metals.

U.S. Pat. No. 4,793,984 issued to B. M. Lok et al. gives descriptions of NZMS materials including MgAPSO molecular sieves and a generalized description of their use in such processes as hydrofining and hydrocracking.

U.S. Pat. No. 4,880,760 issued to R. J. Pellet et al. teaches that hydrocarbon feedstocks can be catalytically hydrodewaxed using a catalyst comprising a nonzeolitic molecular sieve (NZMS). This patent describes the composition and synthesis of a variety of NZMS materials including SAPO and MgAPSO molecular sieves. The patent further teaches (in column 20) that the dewaxing catalyst contains an active metal hydrogenation component. There is broad disclosure of noble metals at a concentration of 0.05 to 1.5%, but that base metals should be present at a concentration greater than 1 wt %. The examples indicate catalyst metals levels of 5% NiO and 23% $WO_3$.

U.S. Pat. Nos. 4,913,798 and 4,913,799 issued to F. P. Gortsema et al. describe hydrocracking processes using catalysts containing NZMS materials including SAPO type materials. These references, which are not directed to dewaxing, have similar teaching as to the concentrations of noble and base metal which may be employed. For instance, column 99 of 4,913,799 refers to base metal concentrations greater than 1 percent. This reference also lists a very wide range of sulfur contents, as hydrogen sulfide, in column 101. These patents and the previously cited U.S. Pat. No. 4,880,760 describe the large number of different compositions referred to herein as NZMS materials and also describe the various ZSM type materials.

U.S. Pat. Nos. 4,859,312; 4,921,594 and 5,149,421 issued to S. J. Miller describe the use of a dewaxing catalyst comprising a silicoaluminophosphate (SAPO) molecular sieve and a metal hydrogenation component to treat heavier feedstocks such as middle distillates. These references describe the amount of hydrogenation metal in the dewaxing catalyst in very broad terms (0.01 to 10.0 wt % of the sieve in column 6 of the '594 patent) and indicate that either a base metal or a noble metal can be used, but give little specific instruction on specific metal content in the catalysts or how the metal content effects performance. The examples describe the use of 0.8 to 1.0 wt. % platinum or palladium to treat very low sulfur feed stocks.

SUMMARY OF THE INVENTION

It has been discovered that a catalyst containing a non-zeolitic molecular sieve (NZMS) and a very low amount of a sulfided base metal component gives surprisingly improved performance in terms of activity and pour point reduction when used to upgrade distillate fuel products including diesel fuel. For instance, the pour point of diesel fuels boiling range material is lowered by dewaxing and the smoke point of kerosene boiling range materials is improved. Lowering the pour point of high boiling paraffins allows the inclusion of more of these paraffins in the diesel fuel thus increasing the yield of diesel fuel.

The invention is a hydrocracking process characterized by the use, either as a separate bed or admixed with other catalyst, of a dewaxing catalyst comprising a very low amount of a metal hydrogenation component and an intermediate pore NZMS, preferably a MgAPSO material. This process is built upon the discovery that even in the presence of a significant amount of sulfur a catalyst containing a very low amount of the metal hydrogenation component gives much superior performance than similar catalysts containing the normal higher amount of the metal component. It has specifically been found that a catalyst comprising about 0.5% sulfided nickel on a MgAPSO support material gives highly stable performance even when processing a diesel fuel containing 2 wt. % sulfur.

A broad embodiment of the invention may be characterized as a hydrocarbon conversion process which comprises the steps of hydrocracking a feed stream comprising hydrocarbons boiling above about 350 degrees C. in a hydrocracking zone in contact with a hydrocracking catalyst comprising a Y zeolite, and producing a hydrocracking zone effluent stream comprising diesel fuel boiling point range hydrocarbons and contacting the product stream with a dewaxing catalyst in a hydrodewaxing zone with as said dewaxing catalyst comprising an intermediate pore NZMS material and from 0.1 to about 0.75 wt percent of a sulfided non-noble metal hydrogenation component.

DETAILED DESCRIPTION

Catalytic processes to upgrade middle distillates have been developed and are being constantly improved. These processes basically seek to improve the quality of fuels and act in different ways. For instance diesel fuel and gasoline may be improved by isomerization of paraffins which decreases the pour point of a diesel fuel and increases the octane number of a gasoline boiling range fuel. The removal of contaminants, such as sulfur and nitrogen compounds, by hydrotreating and the saturation of aromatics are other ways to improve the quality of distillate fractions by hydroprocessing. This can be beneficial in several ways. First, it can be used to improve the cold flow properties of diesel fuels, which become very critical in times of low temperature. Second, it can be used to increase the volume of heavy distillate hydrocarbons which a refinery may blend into a diesel fuel fraction while still meeting the cold flow specifications for diesel fuel. This increases the amount of diesel fuel the refinery can produce.

The subject process employs an NZMS-based catalyst which dewaxes the feed by selective isomerization of long chain paraffins rather than by cracking of the paraffins as done by some other molecular sieves. This results in the subject process producing less light hydrocarbon by-products and providing higher yields of middle distillate products.

Advances in the area of hydrodewaxing have resulted in the development of highly active and selective catalysts. Nevertheless, there is still much need for improvement in such areas as the selectivity, activity and stability of hydrodewaxing catalysts. Another area in which improvements are always sought is cost reduction, both in terms of the cost of the catalyst and also in terms of the catalyst's impact on the capital and operating cost of the processing unit.

It is an objective of the invention to provide an improved catalyst for hydrodewaxing middle distillates such as diesel fuel and jet fuel. It is a further objective of the subject invention to provide a more economical process for upgrading distillate fuels. A specific objective of the invention is to provide a sulfur tolerant hydrodewaxing catalyst which performs dewaxing by isomerization rather than selective cracking.

These objectives are achieved by the surprising discovery that a NZMS material is stable and provides a high level of dewaxing activity at relatively high sulfur levels when only a small amount of hydrogenation metal is present in the catalyst. To appreciate this invention it must be recognized that catalysts' formulations prepared following the prior art and containing a NZMS material such as MAPSO-31 and about 1% highly active platinum as the hydrogenation metal show commercially unacceptable deactivation rates when tested at sulfur levels of 584 ppm as described below. When the normal amount of nickel, a metal which is considered as "sulfur tolerant", was used in this same formulation the catalyst showed greatly reduced activity which required high operating temperatures to achieve the targeted pour point reduction. The high temperatures resulted in the catalyst being highly nonselective with large quantities of undesired lighter hydrocarbons being produced.

We have discovered that a sulfur tolerant paraffin isomerizing dewaxing catalyst can be obtained by departing from the teaching of the prior art and employing a relatively low concentration of a base metal hydrogenation component on a medium pore NZMS material such as MAPSO-31 or MAPSO-36. The increased activity of this system at moderate temperatures provides the added benefit of an increased hydrogenation of aromatic hydrocarbons which improves the properties of jet fuels.

It is believed the improved performance of the subject catalyst results from a better balance between the acidity or cracking activity of the molecular sieve component and the hydrogenation activity of the metal component of the catalyst. No definitive evidence is known which indicates whether this hypothesis is correct. The optimum metal concentrations to obtain the desired balance on the different NZMS materials have not been quantified.

While the improved subject catalyst could be used in an independent process unit to treat a feed stream removed from tankage, it is preferred to use the catalyst in a two-stage process. In one embodiment of the subject process a rather broad boiling range mixture, produced in an upstream cracking zone and overlapping the boiling point range of two or more middle distillate products, is contacting in a second zone with the subject dewaxing catalyst. The source of this mixture is not a limiting feature of the invention and as indicated above is subject to considerable variation. The possible cracking zone sources of the feed stream to second stage or dewaxing zone include but are not limited to (1) an independent upstream hydrocracking process, (2) an integrated hydrocracking zone comprising one or more product separation steps, (3) a bed of hydrocracking catalyst located in the same reaction vessel as the dewaxing catalyst and (4) an upstream fluidized catalytic cracking (FCC) zone. The integrated hydrocracking zone is expected to have a separate hydrocracking reaction zone but can vary considerably in its product recovery steps. The product recovery steps can range from a simple vapor-liquid separation to a product stripping column or a complete product fractionation zone. When the second stage is integrated with a hydrocracking zone, it is preferred that essentially all of the hydrocarbonaceous material having boiling points between 204°–399° C. (400°–750° F.) produced in the hydrocracking zone is passed into the upgrading zone. The extended range feed may even include, if desired, the $C_5$ or $C_6$-plus fraction of the cracking zone effluent distillates and therefore have a boiling point range from about 150° to about 400° C. or higher. Material which is not converted in the first zone is preferably not passed into the second.

The subject invention is specific to the improvement (reduction) in the pour point of hydrocarbons within and just above the diesel fuel boiling range, but also provides other improvements to the feed. The subject process can be applied to either a diesel fuel fraction produced in another processing unit or to a diesel fuel being produced in the same processing unit. The invention can be used to treat hydrocarbons separated into a diesel fuel boiling range fraction or an admixture of hydrocarbons boiling in several motor fuel boiling ranges. That is, it can be applied to a diesel fuel being removed from storage or in a hydrocracking unit to treat hydrocarbon mixtures containing diesel fuel range material produced in an upstream portion of the refinery or in the same reactor.

Typical feedstocks for passage into the first stage hydrocracking reaction zone include virtually any heavy mineral or synthetic oil and fractions thereof. Thus, such feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above 160° Celsius but would not contain appreciable asphaltenes. The feed stream should have a boiling point range between 260°–538° C. Preferred first stage feedstocks therefore include gas oils having at least 50% volume of their components boiling above 700° F. (371° C.). The hydrocracking feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %. It may also contain mono- and/or polynuclear aromatic compounds in amounts of 50 volume percent and higher.

The feed to the dewaxing zone is characterized by: (i) a boiling point range covering all or a major portion of the diesel and jet fuel boiling point ranges and possibly extending above the diesel fuel range and (ii) preferably having a total sulfur content more than 0.5 wt. % and more possibly between 1.0 and 2.0 percent. This feed to the dewaxing zone may have a boiling point range extending from about 204° C. (400° F.) to about 385° C. (725° F.) and preferably from about 150° C. (302° F.) to about 400° C. (752° F.).

An extended boiling range charge stock derived from an upstream hydrocracking zone would be expected to contain hydrocarbons boiling within the gasoline boiling point range which, depending on the situation, extends up to about 380° to 420° F. (193°–216° C.). The hydrogenation capability of the catalysts employed in the subject process will act upon these hydrocarbons as it does on the heavier hydrocarbons. This must be considered in the formulation of a commercial charge stock since hydrogenation of some species may not be desired due to negative effects on, for instance, octane number. Aromatics saturation would also not be desired if a naphtha fraction is destined for an aromatics recovery or reforming zone. Nevertheless, reformulated gasoline compositions may make hydrogenation of the heavy naphtha fraction desirable.

The dewaxing zone is a treating zone rather than conversion or cracking zone. The effluent from the dewaxing zone will comprise an admixture of hydrocarbons having essentially the same boiling point range as the feed which enters the dewaxing zone as only a small amount, preferably less than 10%, conversion by cracking occurs in the dewaxing zone. The conversion which does occur will produce some lower boiling hydrocarbons but the majority of the feed preferably passes through the dewaxing zone with only a minor boiling point change. The effluent of the second zone is fractionated to yield the final product distillate streams. Most preferably less than 5% conversion occurs in the dewaxing zone. Such conversion is normally undesired in a dewaxing process as it reduces the yield of the intended middle distillate products.

As already mentioned, while the preferred source of the feed to the dewaxing (second) reaction zone is a first stage hydrocracking reaction zone the invention is not limited to that process flow configuration and may be used in upgrading feeds from a variety of sources. The feeds can even result from blending operations in which hydrocarbons from two or more conversion units are mixed. One alternative feed source for the dewaxing zone is a fluidized catalytic cracking (FCC) unit. FCC units produce a broad range of products including naphtha, jet fuel, diesel fuel and kerosene. At the present time most of these FCC distillate products will contain a substantial amount of sulfur which otherwise necessitate hydrotreating the distillates before passing them into the catalytic dewaxing zone. However, the subject invention would allow the passage of the FCC diesel into the dewaxing zone without hydrotreating the feed stream. This ability to accept a feed stream containing significant sulfur levels from an FCC unit, or a hydrocracking unit, can result in significant cost savings to a refinery as it is not necessary to hydrotreat the feed stream.

In an FCC process the feed stream such as a gas oil or a HVGO (heavy vacuum gas oil) is contacted with a fluidized or ebulated bed of catalyst. Such a feed has an initial boiling point of about 500°–650° F. (260°–343° C.) and an end boiling point of about 900°–1000° F. (482°–538° C.). This contacting is commonly performed in a riser-type reactor with the feed and catalyst traveling upward through a lengthy vertical reactor and being separated at the outlet of this reactor. Contacting may also occur in a "bubbling" bed of the catalyst retained within a lower portion of a vessel. Average contact times are in the range of about 1.5 to about 5 seconds. FCC reaction conditions also include a temperature of about 900°–1050° F. (482°–566° C.) and an absolute pressure of from atmospheric to about 4 bars. The reaction is normally performed in the absence of added hydrogen. The vaporous portion effluent of the reaction zone is quickly separated from the catalyst and fed to a fractional distillation zone. The reaction zone effluent is therein separated into a stream of light gases such as ethane, propane, propylene, butane and butylene and one or more distillate product streams—typically naphtha, kerosene, diesel fuel and heavy distillate which are withdrawn from the process as separate product streams. FCC processes are widely used commercially and are described in U.S. Pat. Nos. 4,551,229; 4,504,380; 4,384,948; 4,340,566 and 4,211,636 which are incorporated herein by reference.

One embodiment of the invention may accordingly be characterized as a hydrocarbon conversion process which comprises the steps of passing a feed stream into an FCC zone and producing an FCC distillate product stream comprising a mixture of distillate hydrocarbons having a boiling point range extending from about 350° F. to about 700° F.; and passing the FCC distillate product stream into a catalytic hydrodewaxing zone wherein the FCC product stream is contacted with a dewaxing catalyst comprising a NZMS material and between 0.1 and about 0.5 wt. % of a base metal hydrogenation component at conditions which effect both the saturation of jet fuel boiling range aromatic hydrocarbons and the catalytic dewaxing of diesel fuel boiling range hydrocarbons present in this stream.

The subject process is especially useful in the production of middle distillate fractions boiling in the range of about 300°–700° F. (149°–371° C.) as determined by the appropriate ASTM test procedure. These are recovered by fractionating the effluent of the dewaxing zone. The term "middle distillate" is intended to include the diesel, jet fuel and kerosene boiling range fractions. The kerosene or jet fuel boiling point range is intended to refer to a temperature range of about 300°–450° F. (149°–232° C.) and the term "diesel boiling range" is intended to refer to hydrocarbon boiling points of about 338°–about 640° F. (282°–540° C.). Gasoline or naphtha is normally the $C_5$ to 400° F. (204° C.) endpoint fraction of available hydrocarbons. The boiling point ranges of the various product fractions recovered in any particular refinery will vary with such factors as the characteristics of the crude oil source, refinery local markets, product prices, etc. Reference is made to ASTM standards D-975 and D-3699-83 for further details on kerosene and diesel fuel properties.

Hydrocracking conditions employed in the subject process are those customarily employed in the art for hydrocracking. Hydrocracking reaction temperatures are in the range of 400° to 1200° F. (204°–649° C.), preferably between 600° and 950° F. (316°–510° C.). Reaction pressures are in the range of atmospheric to about 3,500 psi (24,233 kPa), preferably between 200 and 3000 psi (1,480–20,786 kPa). A temperature above about 316° C. and a total pressure above about 4238 kPa (600 psi) are highly preferred. As lower pressures aid vaporization a pressure below 13,890 kPa is highly preferred. Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8,888 std. $m^3/m^3$), preferably between 2,000 and 30,000 scf per barrel of charge (355–5,333 std. $m^3/m^3$).

A hydrocracking reaction zone effluent is typically removed from the terminal catalyst bed, heat exchanged with the feed to the reaction zone and then passed into a vapor-liquid separation zone often referred to as a high pressure separator. Additional cooling can be done prior to this separation. In some instances a hot flash separator is used upstream of the high pressure separator. Product recovery methods for hydrocracking are well known and conventional methods may be employed.

In a representative example of a conventional hydrocracking process a heavy gas oil would be charged to the process and admixed with any hydrocarbon recycle stream. The resultant admixture of these two liquid phase streams is heated in an indirect heat exchange means and then combined with a hydrogen-rich recycle gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, reaction by-products such as hydrogen sulfide and ammonia formed by hydrodesulfurization and hydrodenitrification reactions which occur simultaneously with the hydrocracking reaction plus the desired product hydrocarbons boiling in the gasoline, diesel fuel, kerosene or fuel oil boiling point ranges and in addition unconverted hydrocarbons boiling above the boiling point ranges of the desired products. The effluent of the hydrocracking reaction zone will therefore comprise an extremely broad and varied mixture of individual compounds.

Substantially all of the heavier hydrocarbons present in the hydrocracking reaction zone effluent stream are normally passed directly into downstream fractionation facilities without intervening conversion steps. These facilities may include a stripping column operated at conditions effective to separate the entering hydrocarbons and other materials into a net overhead stream and a net bottoms stream. The net overhead stream of a stripping column would comprise essentially all of the propane or butane and lower boiling hydrocarbons and other compounds including hydrogen sulfide which enter the stripping column. Essentially all of the heavier boiling hydrocarbons would be concentrated into the net bottoms stream. The use of the stripping column is preferred, although it is not necessary for successful utilization of the inventive concept. Therefore, a stripping column is not necessary and the entire liquid phase stream recovered from the reaction zone effluent could be passed downstream directly into a product fractionation column.

The conventional product fractionation column is operated under conditions such that the entering hydrocarbons are separated to yield at least two distillate product streams. Preferably at least one light distillate product stream is removed from the product column, such as a stream of naphtha or gasoline boiling range material removed as a net overhead stream, and kerosene and/or diesel fuel boiling range streams are removed as a net sidecut stream(s). The heavy distillate product stream would have a boiling point range between about 260°–538° C. The product fractionation column(s) may also produce a recycle stream of underconverted hydrocarbons.

All or a portion of the unconverted feed material present in the hydrocracking zone effluent may be recycled directly to the hydrocracking zone or may be passed into the second stage and recovered from the effluent of the second stage for recycling to the hydrocracking zone or passed into other processing zones.

The subject process employs two different catalysts. A hydrocracking catalyst preferably comprising a Y-zeolite is preferred for use in the hydrocracking zone to prepare the middle distillates which are then upgraded in the dewaxing stage using a low-metal NZMS material. The NZMS material is preferably an "intermediate pore size" sieve, which is intended to refer to a sieve having a pore size of about 5.3 to about 6.5 Å when in its calcined form in accordance with the industry standards for this term as exemplified by U.S. Pat. No. 5,149,421. A SAPO-36 or, most preferably, a MAPSO-31 type NZMS component is suitable for use in the dewaxing catalyst.

It is preferred that the hydrocracking zone of the subject process employs a conversion catalyst comprising between 1 wt. % and 23 wt. % of a Y zeolite, preferably between 2 wt. % and 10 wt. %. The zeolitic hydrocracking catalyst composition should also comprise a porous refractory inorganic oxide support (matrix) which may form between 80 and 99 wt. %, and preferably between 90 and 98 wt. % of the support of the finished catalyst composite. The matrix may comprise any known suitable refractory inorganic oxide such as alumina, magnesia, silica, titania, zirconia, silica-alumina and the like and combinations thereof.

A Y zeolite has the essential X-ray powder diffraction pattern set forth in U.S. Pat. No. 3,130,007. The as synthesized zeolite may be modified by techniques known in the art which provide a desired form of the zeolite. Thus, modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. The Y zeolites sold by UOP of Des Plaines, Ill. under the trademarks Y-82, LZ-10, LZ-20 and LZ-210 are suitable zeolitic starting materials. These zeolites have been described in the patent literature. The hydrocracking catalyst is preferably essentially free of any NZMS material. As used herein the term "essentially free" is intended to indicate a weight concentration less than about 0.1 percent.

Those skilled in the art are familiar with dealumination techniques such as those described by Julius Scherzer in the article at page 157 of *Catalytic Materials* published by the American Chemical Society in 1984. Other references describing the preparation of dealuminated Y zeolites for use in hydrocracking include U.S. Pat. No. 4,401,556; U.K. Patent 2,014,970; U.K. application 2,114,594A; and U.S. Pat. Nos. 4,784,750; 4,869,803 and 4,954,243. Additional guidance may be obtained from U.S. Pat. Nos. 3,929,672 and 4,664,776. The preferred dealuminated Y zeolite is prepared by a sequence comprising an ion exchange of a starting "sodium Y" zeolite to an "ammonium Y" zeolite and hydrothermal treatment. The ion exchange and hydrothermal treatment are then repeated. The final product should have a sodium content, expressed as $Na_2O$, below about 0.35 and a water adsorption capacity at 25 degrees C. and 10 percent relative humidity of about 3 to 15 weight percent. Excessive dealumination results in the production of a zeolite having a greatly reduced ion exchange capacity and is not desired.

It is contemplated that other zeolites, such as Beta, Omega, L or ZSM-5, could be employed as the zeolitic component of the hydrocracking catalyst in place of the preferred Y zeolite or in admixture with the preferred Y zeolite.

Both the hydrocracking catalyst and the second stage dewaxing catalyst will have their molecular sieve components fixed in an inorganic matrix. The matrix preferably comprises silica-alumina and/or alumina and may be formed of 100 percent alumina. The most preferred matrix for the hydrocracking catalyst comprises a mixture of silica-alumina and alumina wherein said silica-alumina comprises between 15 and 85 wt. % of said matrix. It is preferred that the support comprises from about 5 wt. % to about 45 wt. % alumina.

An alumina component of the catalysts may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina. A large pore alumina such as those sold under the Versal mark by LaRoche Chemicals Inc. of Atlanta, Ga. may also be employed.

The finished hydrocracking and dewaxing catalysts for utilization in the subject process should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/g$ are greatly preferred.

The precise physical characteristics of the two catalysts such as shape and surface area are not considered to be limiting upon the utilization of the present invention. Both catalysts may, for example, exist in the form of pills, pellets, granules, broken fragments, spheres, or various special shapes such as trilobal extrudates, disposed as a fixed bed within a reaction zone. Alternatively, the catalysts may be prepared in a spherical form for use in moving bed reaction zones in which the hydrocarbon charge stock and catalyst are passed either in countercurrent flow or in co-current flow. Another alternative is the use of fluidized or ebulated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow.

A preferred shape for the catalysts used in the subject process is an extrudate. The well-known extrusion method involves mixing the molecular sieve, either before or after adding metallic components, with the binder and a suitable peptizing agent to form a homogeneous dough or thick paste having the correct moisture content to allow for the formation of extrudates with acceptable integrity to withstand direct calcination. Extrudability is determined from an analysis of the moisture content of the dough, with a moisture content in the range of from 30 to 50 wt. % being preferred. The dough is extruded through a die pierced with multiple holes and the spaghetti-shaped extrudate is cut to form particles in accordance with techniques well known in the art. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

One often desired form of the catalyst is a sphere as formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, inorganic oxide sol, and gelling agent into an oil bath maintained at elevated temperatures. The droplets of the mixture remain in the oil bath until they set and form hydrogel spheres. The spheres are then continuously withdrawn from the oil bath and typically subjected to specific aging treatments in oil and an ammoniacal solution to further improve their physical characteristics. The resulting aged and gelled particles are then washed and dried at a relatively low temperature of about 50°–200° C. and subjected to a calcination procedure at a temperature of about 450°–700° C. for a period of about 1 to about 20 hours. This treatment effects conversion of the hydrogel to the corresponding inorganic oxide matrix. In this technique the zeolite and silica-alumina must be admixed into the metal containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to both the hydrocracking catalyst and the dewaxing catalyst before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos. 3,929,672; 4,422,959; 4,576,711; 4,661,239; 4,686,030; and, 4,695,368 which are incorporated herein by reference.

Hydrogenation components contemplated for use in the hydrocracking catalyst are those catalytically active components selected from the Group VIB and Group VIII metals and their compounds. References herein to Groups of the Periodic Table are to the traditionally American form as reproduced in the fourth edition of *Chemical Engineer's*

*Handbook*, J. H. Perry editor, McGraw-Hill, 1963. Generally, the amount of hydrogenation components present in the final catalyst composition is small compared to the quantity of the other above-mentioned molecular sieve and support components. The Group VIII component generally comprises about 0.1 to about 20% by weight, preferably about 1 to about 15% by weight of the final catalytic composite calculated on an elemental basis. The Group VIB component of the hydrocracking catalyst comprises about 0.05 to about 20% by weight, preferably about 0.5 to about 10% by weight of the final catalytic composite calculated on an elemental basis. The total amount of Group VIII metal and Group VIB metal in the finished catalyst in the hydrocracking catalyst is preferably less than 21 wt. percent. The hydrogenation components contemplated for inclusion in the hydrocracking catalysts include one or more metals chosen from the group consisting of molybdenum, tungsten, chromium, iron, cobalt, nickel, platinum, palladium, iridium, osmium, rhodium, ruthenium and mixtures thereof. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrocracking catalyst.

The dewaxing catalyst used in the subject process comprises a non-zeolitic molecular sieve material and is preferably essentially free of Y zeolite. The dewaxing catalyst is also preferably essentially free of molecular sieves referred to in the art as ZSM zeolites such as ZSM-5. "Non-zeolitic molecular sieves" (NZMS) materials contain framework tetrahedral units ($TO_2$) of aluminum ($AlO_2$), phosphorus ($PO_2$) and at least one additional element EL ($ELO_2$). Non-zeolitic molecular sieves include the "ELAPSO" molecular sieves as disclosed in U.S. Pat. No. 4,793,984 (Lok et al.), "SAPO" molecular sieves of U.S. Pat. No. 4,440,871 (Lok et al.) and crystalline metal aluminophosphates—MeAPOs where "Me" is at least one of Mg, Mn, Co and Zn—as disclosed in U.S. Pat. No. 4,567,029 (Wilson et al.). Framework As, Be, B, Cr, Fe, Ga, Ge, Li, Ti or V and binary metal aluminophosphates are disclosed in various species patents. Particularly relevant to the present invention is U.S. Pat. No. 4,758,419 (Lok et al.), which discloses MgAPSO non-zeolitic molecular sieves and which is incorporated herein by reference. MgAPSO sieves have a microporous crystalline framework structure of $MgO_2^{-2}$, $AlO_2^{-}$, $PO_2^{+}$, and $SiO_2$ tetrahedral units having an empirical chemical composition on an anhydrous basis expressed by the formula:

$$mR: (Mg_wAl_xP_ySi_z)O_2$$

wherein "R" represents at least one organic templating agent present in the intracrystalline pore system; "m" represents the molar amount of "R" present per mole of $(Mg_wAl_xP_ySi_z)O_2$ and has a value of zero to about 0.3; and "w", "x", "y" and "z" represent the mole fractions of element magnesium, aluminum, phosphorus and silicon, respectively, present as tetrahedral oxides. The mole fraction of each framework constituent of the molecular sieve is defined as a compositional value which is plotted in phase diagrams of U.S. Pat. No. 4,758,419. The mole fractions "w", "x", "y" and "z" are generally defined as being within the limiting compositional values or points as follows:

| | Mole Fraction | | |
|---|---|---|---|
| Point | x | y | (z + w) |
| A | 0.60 | 0.38 | 0.02 |
| B | 0.39 | 0.59 | 0.02 |
| C | 0.01 | 0.60 | 0.39 |
| D | 0.01 | 0.01 | 0.98 |
| E | 0.60 | 0.01 | 0.39 |

The nomenclature employed herein to refer to the members of the class of MgAPSOs is consistent with that employed in the aforementioned patents. A particular member of a class is generally referred to as a "-n" species wherein "n" is an integer, e.g., MgAPSO-11, MgAPSO-31 and MgAPSO-41. The especially preferred species of the present invention is MgAPSO-31 having a characteristic X-ray powder diffraction pattern which contains at least the d-spacings set forth below:

| 2θ | d | Relative Intensity |
|---|---|---|
| 8.4–9.501 | 10.53–9.3084 | w–s |
| 20.2–20.4 | 4.40–4.35 | m |
| 22.0–22.1 | 4.04–4.022 | m |
| 22.5–22.7 | 3.952–3.92 | vs |
| 23.15–23.35 | 2.831–2.814 | w–m |

MgAPSO sieves generally are synthesized by hydrothermal crystallization from an aqueous reaction mixture containing reactive sources of magnesium, silicon, aluminum and phosphorus and an organic templating agent for an effective time at effective conditions of pressure and temperature. The reaction-mixture compositions preferably are expressed in terms of molar ratios as follows:

$$aR: (Mg_rAl_sP_tSi_u)bH_2O$$

wherein (r+s+t+u)=1.00 mole such that the aforementioned framework constituents "w", "x", "y" and "z" of the molecular sieves have the compositional values as described, the amount "a" of organic templating agent has a positive value between 0 and about 6, and the amount of water "b" is between 0 and 500 with a preferable value between 2 and 300.

The organic templating agent, if any, can be selected from among those disclosed in U.S. Pat. No. 4,758,419. Generally this agent will contain one or more elements selected from Group VA (IUPAC 15) of the Periodic Table [See Cotton and Wilkinson, *Advanced Inorganic Chemistry*, John Wiley & Sons (Fifth Edition, 1988)], preferably nitrogen or phosphorus and especially nitrogen, and at least one alkyl or aryl group having from 1 to 8 carbon atoms. Preferred compounds include the amines and the quaternary phosphonium and quaternary ammonium compounds. Mono-, di- and tri-amines are advantageously utilized, either alone or in combination with a quaternary ammonium compound. Especially preferred amines include di-isopropylamine, di-n-propylamine, triethylamine and ethylbutylamine.

After crystallization the MgAPSO product may be isolated and advantageously washed with water and dried in air. The as-synthesized MgAPSO will typically contain within its internal pore system at least one form of any templating agent, also referred to as the "organic moiety", employed in its formation. Most commonly the organic moiety is present, at least in part, as a charge-balancing cation. In some cases, the MgAPSO pores are sufficiently large and the organic molecule sufficiently small that the removal of the latter may be effected by conventional desorption procedures. Generally, however, the organic moiety is an occluded molecular species which is too large to move freely through the pore system of the MgAPSO product and must be thermally degraded and removed by calcining at temperatures of from 200° to 700° C.

The MgAPSO compositions are formed from $MgO_2$, $AlO_2$, $PO_2$ and $SiO_2$ tetrahedral units which, respectively, have a net charge of −2, −1, +1 and 0. An $AlO_2^-$ tetrahedron can be balanced electrically either by association with a $PO_2^+$ tetrahedron or a simple cation such as an alkali metal cation, a proton ($H^+$), a cation of magnesium present in the reaction mixture, or an organic cation derived from the templating agent. Similarly, an $MgO_2^-$ tetrahedron can be balanced electrically by association with $PO_2^+$ tetrahedra, a simple cation such as alkali metal cation, a proton ($H^+$), a cation of the magnesium, organic cations derived from the templating agent, or other divalent or polyvalent metal cations introduced from an extraneous source. Ion exchange of MgAPSO compositions will ordinarily be possible only after the organic moiety present as a result of synthesis has been removed from the pore system.

The second stage or distillate dewaxing catalyst is preferably prepared by combining the NZMS material with a support material suitable for formation of catalyst particles. The support material should be highly porous and have a surface area of about 25 to about 500 $m^2/g$, uniform in composition and relatively refractory to the conditions utilized in the hydrocarbon conversion process. The term "uniform in composition" denotes a support which is unlayered, has no concentration gradients of the species inherent to its composition, and is completely homogeneous in composition to the extent feasible in mass production. Thus, if the support is a mixture of two or more refractory materials, the relative amounts of these materials will be constant and uniform throughout the entire support. It is intended to include within the scope of the present invention support materials which have traditionally been utilized in hydrocarbon conversion catalysts such as: (1) refractory inorganic oxides including alumina, titanium dioxide, zirconium dioxide, chromium oxide, zinc oxide, magnesia, thoria, boria, silica-alumina, silica-magnesia, chromia-alumina, alumina-boria, silica-zirconia, etc.; (2) silica or silica gel, clays and silicates including those synthetically prepared and naturally occurring, which may or may not be acid treated, for example attapulgus clay, diatomaceous earth, fuller's earth, kaolin, kieselguhr, etc.; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; and, (4) combinations of materials from one or more of these groups.

The preferred support materials are refractory inorganic oxides, preferably alumina. Suitable aluminas are the crystalline aluminas known as the gamma-, eta-, and theta-aluminas. Excellent results are obtained with a matrix of substantially pure gamma-alumina. Whichever type of matrix is employed, it may be activated prior to use by one or more treatments including but not limited to drying, calcination, and steaming.

The dewaxing catalyst contains a positive amount less than about 0.75 wt percent of a metal hydrogenation component. Unless otherwise specified the concentration of any metal component of a catalyst described herein is intended to indicate the amount of metal present in terms of the elemental metal as compared to a sulfide or oxide. The metal hydrogenation component may comprise a Group VIII metal such as nickel or cobalt. A preferred metal component for the dewaxing catalyst is a base metal chosen from the group consisting of nickel, tungsten and molybdenum or a mixture of one of these metals. The dewaxing catalyst is preferably essential free of any platinum-group metal including platinum, palladium, rhodium, osmium, and iridium and more preferably contains less than 0.05 wt percent of any of these metals. It is, however, contemplated that ruthenium may be a suitable sulfur resistant metal component for the dewaxing catalyst when used at the low metal component level of the subject invention. The metal component of the dewaxing catalyst may exist within the final catalyst composite as a compound such as an oxide, sulfide, halide, oxysulfide, etc., or as an elemental metal or in combination with one or more other ingredients of the catalytic composition. It is presently preferred to employ a base metal component which exists in a fully sulfided state. The metal hydrogenation component is preferably present at a concentration of from about 0.01 to about 0.5 mass % of the NZMS component of the dewaxing catalyst, calculated on an elemental basis.

The metal component may be incorporated into the dewaxing catalyst composite in any suitable manner. One commonly employed method of preparing the catalyst involves the utilization of a water-soluble, decomposable compound of a metal to impregnate the calcined zeolite/binder composite. For example, the base metal component may be added to the calcined hydrogel by commingling the calcined composite with an aqueous solution of nickel chloride. It is preferred to ion exchange the base metal into the NZMS powder prior to forming the finished catalyst particle.

In the subject process the dewaxing zone is operated at dewaxing conditions which include a pressure of about 10 to 150 atmospheres, temperatures of about 250° to 500° C., liquid hourly space velocities of from about 0.1 to 100 $hr^{-1}$, and hydrogen-to-hydrocarbon molar ratios of from about 0.1 to 10. When the dewaxing zone is immediately downstream of a hydrocracking zone, e.g., in the same vessel, it will be operated at essentially the same conditions as the hydrocracking zone. Interstage cooling, as by quench, could be used to reduce the temperature and promote hydrogenation.

The hydrocarbonaceous material charged to the dewaxing zone may be relatively high in sulfur content compared to traditional hydrodewaxing processes. The sulfur content of the hydrocarbon feed to the dewaxing zone may range up to 3 wt. percent but is preferably below about 2.0 wt. percent. Sulfur contents of 0.5–2.0 wt. % are therefore expected. In this context, the term "sulfur content" refers to sulfur chemical combined into the hydrocarbonaceous compounds and excludes hydrogen sulfide. The desulfurization provided by the first stage hydrocracking step may provide a sufficiently low sulfur content in an otherwise untreated high-sulfur feed. Hydrogen sulfide liberated by hydrocracking may be removed from the charge stream to the dewaxing zone by flashing, stripping or fractionation. It is also contemplated that a countercurrent hydrogen-hydrocarbon flow can be employed in the hydrocracking zone to produce a conversion zone effluent having a low hydrogen sulfide content to be passed directly into the dewaxing zone.

One broad embodiment of the invention may accordingly be characterized as a hydrocracking process which comprises the steps of contacting a hydrocarbonaceous feedstream having a 10 percent boiling point above about 316° C. (600° F.) and hydrogen with a first stage hydrocracking catalyst at conditions which effect a reduction in the average molecular weight of the feed stream, the partial desulfurization of the feedstream and the production of a first stage effluent stream having a total sulfur content above about 1.0 wt. % and comprising distillate product hydrocarbons having a boiling point range extending from at least about 150° to about 400° C.; contacting the first stage effluent stream with a dewaxing catalyst which comprises an intermediate pore NZMS component and from about 0.1 to about 0.75 wt. % of a hydrogenation component comprising a sulfided non-noble metal in a second stage operated at dewaxing conditions which effect the dewaxing of diesel fuel boiling range hydrocarbons and the production of a second stage effluent stream; and, recovering a middle distillate product stream comprising diesel fuel boiling range hydrocarbons from the second stage effluent stream.

A preferred embodiment of the invention may be a hydrocracking process which comprises the steps of contacting a hydrocarbonaceous feedstream having a 10 percent boiling point above about 316° C. (600° F.) and hydrogen with a first stage hydrocracking catalyst at conditions which effect a reduction in the average molecular weight of the feed stream, the partial desulfurization of the feedstream and the production of a first stage effluent stream comprising at least 0.5 wt. % sulfur and distillate product hydrocarbons having a boiling point range extending from at least about 150° to about 400° C.; contacting the first stage effluent stream with a second stage dewaxing catalyst which comprises a MgAPSO and from about 0.01 to about 0.5 wt. % of a hydrogenation component comprising sulfided nickel at dewaxing conditions which include a lower temperature than said hydrocracking conditions and which effect the isomerization of diesel fuel boiling range hydrocarbons and the production of a second stage effluent stream; and recovering a middle distillate product stream comprising diesel fuel boiling range hydrocarbons from the second stage effluent stream.

EXAMPLE 1

This example illustrates the adverse effects of sulfur on the performance of a prior art type NZMS dewaxing catalysts. The test results presented below were obtained in a pilot plant loaded with approximately 185 grams of a NZMS catalyst comprising 0.4 wt. % platinum on MAPSO-31 molecular sieve (Catalyst "A"). The catalyst contained 80 wt. percent molecular sieve and 20 percent alumina binder and was prepared as a 1/16 inch extrudate having a piece density of 1.146 g/cc. The feed stream was derived from the diesel boiling range fraction recovered by fractional distillation from the effluent of a commercial hydrocracking unit. The raw feed (Feed "1") contained about 5 ppm sulfur, with ditertiary butyldisulfide being added to the raw feed to achieve the higher sulfur levels used in the tests. The raw feed is described in more detail in Table 1. The pilot plant was operated at a pressure of 6895 kPa (1000 psig), a distributed average bed temperature of 625° F. (329° C.), a liquid hourly space velocity of 1.0 $hr^{-1}$ and a once-through hydrogen circulation rate of 888 std $m^3/m^3$ (5,000 std $ft^3$/barrel). The average bed temperature of the reactor was maintained constant to measure the effects of the sulfur content of the feed stream. The pilot plant included a reactor effluent cooler, vapor/liquid separator, product stripping column and product recovery column. The reported results of Table 3 are for the bottoms liquid fraction of the recovery column.

In Test 1 the pilot plant was operated with the raw (low sulfur) feed with the result that the Total Normal Paraffins (TNP) content was reduced from 11.8 wt. percent to less than 2 wt. % indicating high isomerization activity. The pour point of the product was about −35° F. (−67° C.). During Test 2 the sulfur content was increased to 117 ppm (100 ppm target) and the pour points immediately rose by about 15 Fahrenheit degrees (8 Celsius degrees) but there was only minimal effect on the TNP or aromatic content of the product. When the sulfur level in the feed was increased to 584 ppm (500 ppm target) during Test 3 catastrophic deactivation occurred with the product TNP level exceeding 7 wt. percent and the pour point rising to above 23° F. (−5° C.). The conversion levels measured in terms of the total $C_7$-plus products boiling below 500° F. (260° C.) dropped considerably from 19.4% with the raw feed to 17.4% with 100 ppm sulfur to 13% with 500 ppm sulfur. The amount of aromatics in the product also increased drastically indicated that sulfur in the feed also greatly reduced the hydrogenation activity of the catalyst.

The absolute activity of a dewaxing catalyst is important because it sets the required operating temperature. The temperature in turn has a great impact on the amount of aromatics hydrogenation which occurs during the dewaxing step since the amount of hydrogenation is inversely proportional to temperature. As the hydrogenation of aromatic hydrocarbons in the kerosene and jet fuel boiling range has significant benefits in terms of improved (higher) smoke points (ASTM method D-1322) it is therefore very desirable to operate at lower temperatures. An important factor in judging the commercial potential of any dewaxing catalyst is whether it possesses enough dewaxing activity to allow operation of the dewaxing zone at an optimum hydrogenation temperature. This optimum temperature exists because the aromatics concentration in the dewaxing zone product goes through a temperature dependent minimum. Increasing the reactor temperature above this optimum temperature to obtain increased dewaxing therefore decreases the amount of aromatics hydrogenation (more aromatics are present in the product). An average dewaxing zone temperature below 329° C. (625° F.) is preferred. A preferred temperature is within the broad range of about 288° to 329° C. (550° to 625° F.) and highly preferred temperatures are from about 302° to 329° C. (575° to 625° F.).

The preference for the dewaxing operation to be performed at a lower temperature than the hydrocracking can be easily accommodated in a single reactor containing both the hydrocracking and dewaxing zones by quenching the reactants at a point in the reactor between these two zones. The quench fluid may be hydrogen or a hydrocarbon liquid. One suitable liquid is a portion of the stripped or unstripped diesel or jet fuel boiling range product recovered from the process. The recycling effected by this limited embodiment will result in increased hydrogenation of aromatic hydrocarbons and isomerization of paraffinic hydrocarbons thereby further increasing product quality.

EXAMPLE 2

In this example the performance of two different non-noble catalysts is compared at high sulfur levels. The Catalysts "B" and "C" differed in terms of their hydrogenation component, with the metal and its concentration being varied. Both catalysts were sulfided. The nickel hydrogenation component was added after the support was formed. The same pilot plant and raw feed was used as in Example 1 for test 4, but feed 2 of Table 1 was used in tests 5 and 6 when the supply of feed 1 ran out. The feed for all three tests in this example was spiked with ditertiary butyldisulfide to a target concentrations of 500 and 20000 ppm., with all of the tests being run with high sulfur levels. The pilot plant was operated at the same conditions as in Example 1 except that the temperature was increased in steps to measure the activity of the catalyst and establish the temperature needed for decreasing the pour point of the feed to below 0° F. (−18° C.).

The catalysts were all able to achieve this targeted reduction in the pour point (ASTM method D-97) of the feed. However, the high and low nickel catalysts differed greatly in the minimum average reactor temperature required to achieve this reduction, in their selectivity and their stability. The minimum required temperature is important as increased reactor temperature, which normally results in increased isomerization of normal paraffins and lower product pour points also normally correlates with reduced aromatics saturation and increased conversion of the feed to undesired light by-products. This is because hydrogenation is less thermodynamically favored at higher temperatures. Table 3 summarizes the test results in terms of these very important factors, which determine the suitability of a catalyst for commercial use.

The results show that the platinum containing catalyst does not possess satisfactory conversion activity or hydrogenation activity at the higher sulfur level of test 3. The total normal paraffin concentration in the product was the highest of all 6 tests. The results also indicate that the high nickel catalyst, Catalyst "B" provided extremely poor aromatics hydrogenation and only moderate TNP improvement. The high nickel catalyst was found to have low conversion activity and required a temperature of 675° F. (357° C.) to achieve the targeted pour point reduction to 0° F. (−18° C.). This high temperature in turn reduced selectivity to middle distillate products. In comparison the sulfided low nickel catalyst, Catalyst "C", of the present invention displayed high conversion activity and selectivity with excellent pour point reduction at 625° F. (329° C.). The performance of this catalyst was not influenced even by a high sulfur content level of 20,000 ppm. Catalyst "C" provided some of the lowest TNP product values with little detrimental impact by a 40-fold increase in sulfur over the level which adversely affected the high nickel catalyst.

TABLE 1

| Diesel Feed Compositions | Feed 1 | Feed 2 |
|---|---|---|
| I.B.P. (°C.) | 143 | 135 |
| 10% b.p. | 257 | 267 |
| 90% b.p. | 394 | 408 |
| API | 41.0 | 40.3 |
| Pour Point (°F.) | 45 | 54 |
| Cloud Point (°F.) | 46 | 54 |
| Aromatics (vol. %) | 10.1 | 5.6 |
| Nitrogen, ppm | <2 | <1 |
| TNP | 11.8 | 10.3 |

TABLE 2

| Catalyst Compositions | | | |
|---|---|---|---|
| Catalyst | A | B | C |
| Sieve Type | MAPSO-31 | MAPSO-31 | MAPSO-31 |
| Binder | Alumina | Alumina | Alumina |
| Metal/wt. % | Pt/.4 | Ni*/4.0 | Ni*/.5 |

*Sulfided

TABLE 3

| Catalyst Performance Data | Test 1 | Test 2 | Test 3 | Test 4 | Test 5 | Test 6 |
|---|---|---|---|---|---|---|
| Catalyst | A | A | A | B | C | C |
| Sulfur, wt., ppm | ~5 | 117 | 584 | 470 | 500 | 20,100 |
| Required Min. Temperature, °F. | 625 | 625 | 625 | 675 | 625 | 625 |
| API (500 F plus) | 41.7 | 41.5 | 41.1 | 40.1 | 39.4 | 39.1 |
| Aromatics | 1.6 | 1.9 | 6.1 | 12.1 | 9 | 8.8 |
| Yields wt. % | | | | | | |
| $C_6$-minus | 5.0 | 3.7 | 3.1 | 7.8 | 12 | 11 |
| $C_7$-300° F. | 3.8 | 2.5 | 1.3 | 2.2 | 1.9 | 1.3 |
| 300–500° F. | 16.1 | 14.9 | 11.7 | 12.9 | 7.8 | 10.6 |
| 500° F.-plus | 75.6 | 79.5 | 84.4 | 77.4 | 74.9 | 71.8 |
| Deactivation* | None | None | High | None | None | None |
| Total Normal Paraffins (wt. %) | 1.76 | 2.5 | 7.1 | 4.8 | 1.6 | 1.7 |
| Pour Point (°F.) | −35 | −20 | 23 | −8 | −17 | −20 |
| CFPP[1] (°F.) | −6 | −9 | 27 | 15 | 14 | 15 |

*Deactivation is reported as "none" if no deactivation occurs over two days of operation. Based upon observed trend(s) in TNP, CFPP, Pour Point

[1]Cold Filter Plug Point - a European pour point test.

What is claimed:

1. In a hydrocarbon conversion process which comprises the steps of hydrocracking a feed stream comprising hydrocarbons boiling above about 350 degrees C. in a hydrocracking zone in contact with a hydrocracking catalyst comprising a Y zeolite, and producing a hydrocracking zone effluent stream comprising diesel fuel boiling point range hydrocarbons and contacting the product stream with a dewaxing catalyst in a hydrodewaxing zone; the improvement which comprises employing as said dewaxing catalyst a composite comprising an intermediate pore NZMS material and from about 0.1 to about 0.75 wt. percent of a sulfided non-noble metal hydrogenation component as the sole hydrogenation component.

2. The process of claim 1 further characterized in that the metal hydrogenation component is chosen from the group consisting of nickel, molybdenum and tungsten.

3. The process of claim 2 further characterized in that the hydrocracking zone effluent stream contains at least 0.5 wt. % sulfur.

4. The process of claim 2 further characterized in that the catalyst comprises less than about 0.5 wt. % metal hydrogenation component.

5. The process of claim 2 further characterized in that the NZMS material is SAPO-31.

6. The process of claim 1 further characterized in that the NZMS material is SAPO-11.

7. A hydrocarbon conversion process which comprises the steps:

a) contacting a hydrocarbonaceous feedstream having a 10 percent boiling point above about 316° C. (600° F.) and hydrogen with a first stage hydrocracking catalyst at conditions which effect a reduction in the average molecular weight of the feed stream and the partial desulfurization of the feedstream and producing a first stage effluent stream having a total sulfur content above about 1.0 wt. % and comprising distillate product hydrocarbons having a boiling point range extending from at least about 150° to about 400° C.;

b) contacting the first stage effluent stream with a dewaxing catalyst which comprises an intermediate pore NZMS component and from about 0.1 to about 0.75 wt. % of a hydrogenation component comprising a sulfided non-noble metal as the sole hydrogenation component in a second stage operated at dewaxing conditions which effect the dewaxing of diesel fuel boiling range hydrocarbons and the production of a second stage effluent stream; and c) recovering a middle distillate product stream comprising diesel fuel boiling range hydrocarbons from the second stage effluent stream.

8. The process of claim 7 further characterized in that the first stage hydrocracking catalyst comprises a Y zeolite.

9. The process of claim 8 further characterized in that the hydrocracking catalyst is essentially free of NZMS materials.

10. The process of claim 9 further characterized in that the dewaxing catalyst is essentially free of Y zeolite.

11. The process of claim 10 further characterized in that the process comprises less than about 0.5 wt. % hydrogenation component.

12. The process of claim 7 further characterized in that the dewaxing conditions include a temperature of about 288° to about 329° C.

13. The process of claim 7 further characterized in that the NZMS component is chosen from the group consisting of the SAPO-11, SAPO-31 and SAPO-41 molecular sieves.

14. A hydrocracking process which comprises the steps:

a) contacting a hydrocarbonaceous feedstream having a 10 percent boiling point above about 316° C. (600° F.) and hydrogen with a first stage hydrocracking catalyst at conditions which effect a reduction in the average molecular weight of the feed stream, the partial desulfurization of the feedstream and the production of a first stage effluent stream comprising at least 0.5 wt. % sulfur and distillate product hydrocarbons having a boiling point range extending from at least about 150° to about 400° C.;

b) contacting the first stage effluent stream with a second stage dewaxing catalyst which comprises a MgAPSO and from about 0.01 to about 0.5 wt. % of hydrogenation component comprising sulfided nickel as the sole hydrogenation component at dewaxing conditions which include a lower temperature than said hydrocracking conditions and which effect the isomerization of diesel fuel boiling range hydrocarbons and the production of a second stage effluent stream; and c) recovering a middle distillate product stream comprising diesel fuel boiling range hydrocarbons from the second stage effluent stream.

15. The process of claim 14 further characterized in that the dewaxing conditions include a temperature of from 302° to 329° C.

16. A hydrocarbon conversion process which comprises the steps of passing a feed stream into an FCC zone and producing an FCC distillate product stream comprising a mixture of distillate hydrocarbons having a boiling point range extending from about from about 350° F. to about 700° F.; and passing the FCC distillate product stream into a catalytic hydrodewaxing zone wherein the FCC product stream is contacted with a dewaxing catalyst comprising a NZMS material and between 0.1 and about 0.5 wt. % of a base metal hydrogenation component as the sole hydrogenation component at conditions which effect both the saturation of jet fuel boiling range aromatic hydrocarbons and the catalytic dewaxing of diesel fuel boiling range hydrocarbons present in this stream.

* * * * *